US006296267B1

(12) United States Patent
Buquet

(10) Patent No.: US 6,296,267 B1
(45) Date of Patent: Oct. 2, 2001

(54) SKI BOOT SAFETY BINDING

(75) Inventor: Thierry Buquet, Varennes Vauzelles (FR)

(73) Assignee: Look Fixations S.A., Nevers (FR)

( * ) Notice: Subject to any disclaimer, the term of this patent is extended or adjusted under 35 U.S.C. 154(b) by 0 days.

(21) Appl. No.: 09/103,156

(22) Filed: Jun. 22, 1998

(30) Foreign Application Priority Data

Jun. 26, 1997 (FR) ..... 97-08312

(51) Int. Cl.[7] ..... A63C 9/08
(52) U.S. Cl. ..... 280/626; 280/634
(58) Field of Search ..... 280/624, 626, 280/628, 629, 632, 634

(56) References Cited

U.S. PATENT DOCUMENTS

| | | | |
|---|---|---|---|
| 3,249,365 | 5/1966 | Beyl | 280/626 |
| 3,964,759 | 6/1976 | Salomon | 280/626 |
| 3,970,326 | 7/1976 | Salomon | 280/626 |
| 4,607,859 | 8/1986 | Wittmann et al. | 280/634 X |
| 4,629,209 | 11/1986 | Lorenz et al. | 280/626 |
| 4,681,338 | 7/1987 | Spitaler | 280/626 X |

FOREIGN PATENT DOCUMENTS

| | | |
|---|---|---|
| 561008 | 9/1993 | (DE) . |
| 2652273 | 3/1991 | (FR) . |

*Primary Examiner*—Michael Mar
(74) *Attorney, Agent, or Firm*—Bugnion S.A.; John Moetteli

(57) ABSTRACT

The heel piece of a safety binding for holding a boot on a ski, comprises a tubular binding body which is open at its two ends, is rigidly linked to a sole grip (1*a*) and is articulated about a transverse cam forming part of a stirrup piece (3) which is articulated onto a pivoting plate (4) joined to the ski, this body containing at least one spring which works in compression between a piston bearing on the cam, and a stop secured to a setting screw. The setting screw bears axially, by its head, against a bearing zone of the binding body, and the stop consists of a nut mounted on the setting screw, the screw, with its stop, the spring and the piston being mounted in the body through the end corresponding to the sole grip.

3 Claims, 4 Drawing Sheets

SKI BOOT SAFETY BINDING

FIELD OF THE INVENTION

The invention relates to a heel piece of a safety binding for holding a boot on a ski, comprising a tubular binding body which is open at its two ends, is rigidly linked to a sole grip and is articulated about a transverse cam forming part of a stirrup piece which is articulated about a horizontal axis onto a plate mounted so as to pivot on the ski about a substantially vertical axis, this body containing at least one spring which works in compression between a piston bearing on the cam, and a stop secured to a setting screw.

PRIOR ART

A heel piece of this type, referred to as a pivot heel piece, is described in patent CH 397 500. Moreover, this binding has become a brand image of the applicant over the years. In this heel piece, the stop consists of the setting screw, itself in the form of a screw threaded plug screwed into the tapped end of the binding body. This binding body is in the form of a tube closed on the sole grip side. An embodiment of this type therefore requires the manufacture of a special screw and the tapping of the binding body. This machining represents relatively expensive operations.

In addition, patent FR 2 034 708 discloses a heel piece which is of the same type, but in which the body of the binding is open on the sole grip side. The adjustable stop also consists of a special screw screwed into a tap of the body of the binding, and the cam is mounted between two springs. Access to the setting screw is not very convenient.

SUMMARY OF THE INVENTION

The object of the present invention is to reduce the cost of manufacturing the heel piece.

To this end, the heel piece according to the invention is one wherein the setting screw bears axially, by its head, against a bearing zone of the binding body, and wherein the stop consists of a nut mounted on the setting screw.

It is easy to form a bearing zone at the upper end of the body of the binding by leaving a shoulder around the opening. It is then possible to use a simple commercially available collared screw which bears by its collar against this bearing zone. A nut, for example of the knurled nut type, can be used as a stop. The knurling can at the same time be used as an index for displaying the release setting of the binding.

Between the screw and the bearing zone, a sliding part with low coefficient of friction is advantageously arranged. At the same time, this sliding part seals the binding body on the setting screw side.

The screw with its stop, the spring and the piston are mounted in the binding body through the end corresponding to the sole grip.

Setting continues to take place through the most accessible end of the heel piece.

BRIEF DESCRIPTION OF THE DRAWINGS

The appended drawing represents an embodiment of the heel piece according to the invention by way of example.

DESCRIPTION OF THE PREFERRED EMBODIMENT

Figure 1:
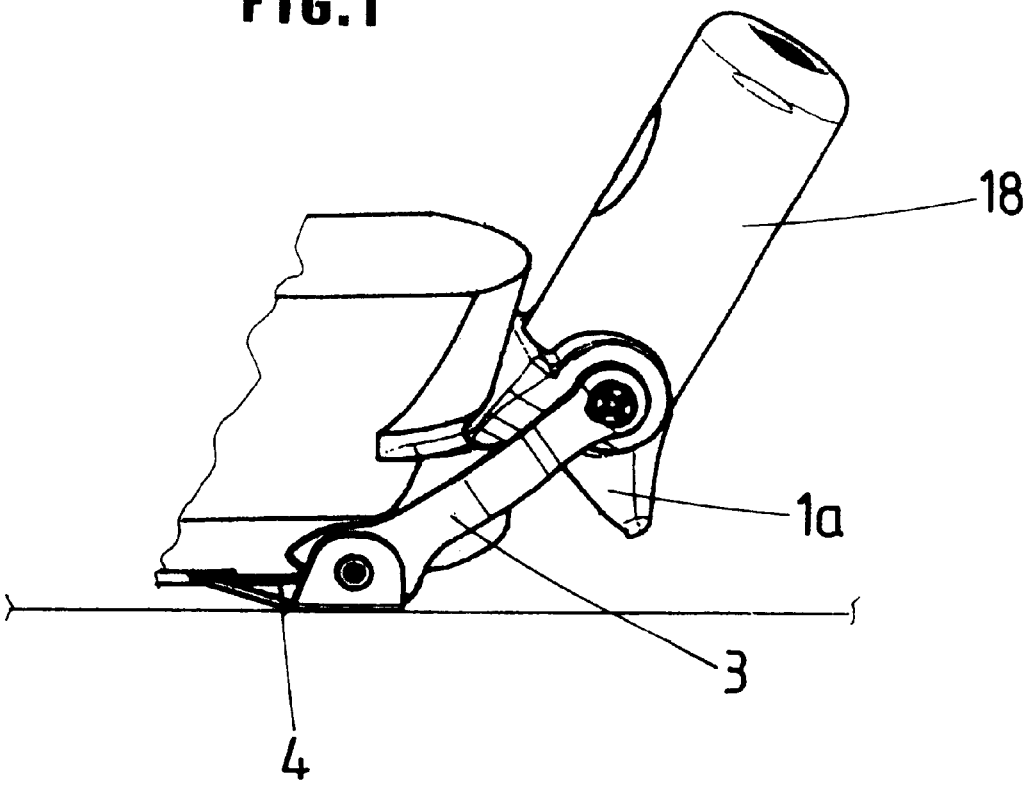
FIG. 1 is a perspective view of the heel piece when it is closed on a boot.
Figure 2:
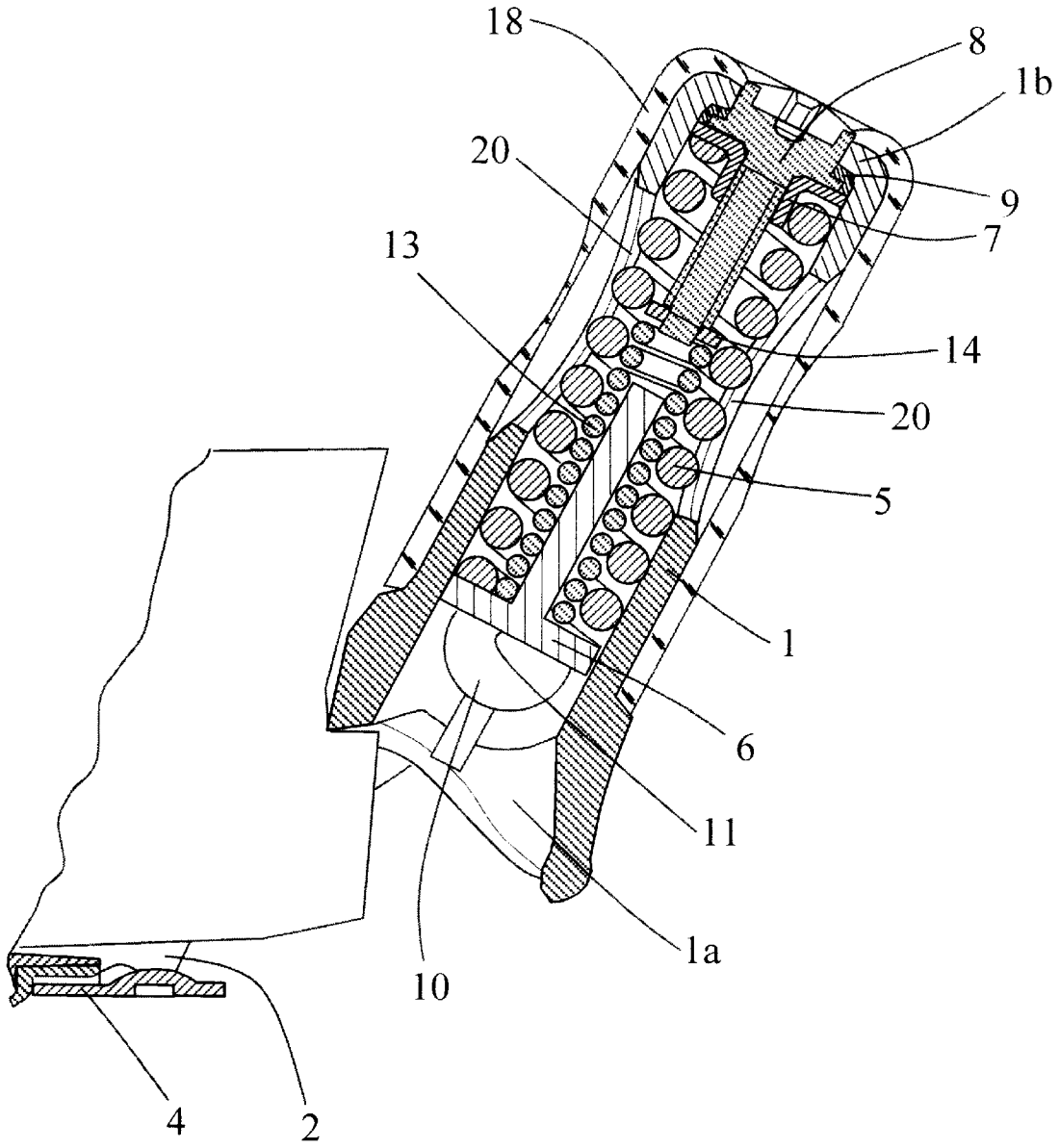
FIG. 2 is a view in axial section, on a vertical plane, of the binding body represented in FIG. 1.
Figure 3:
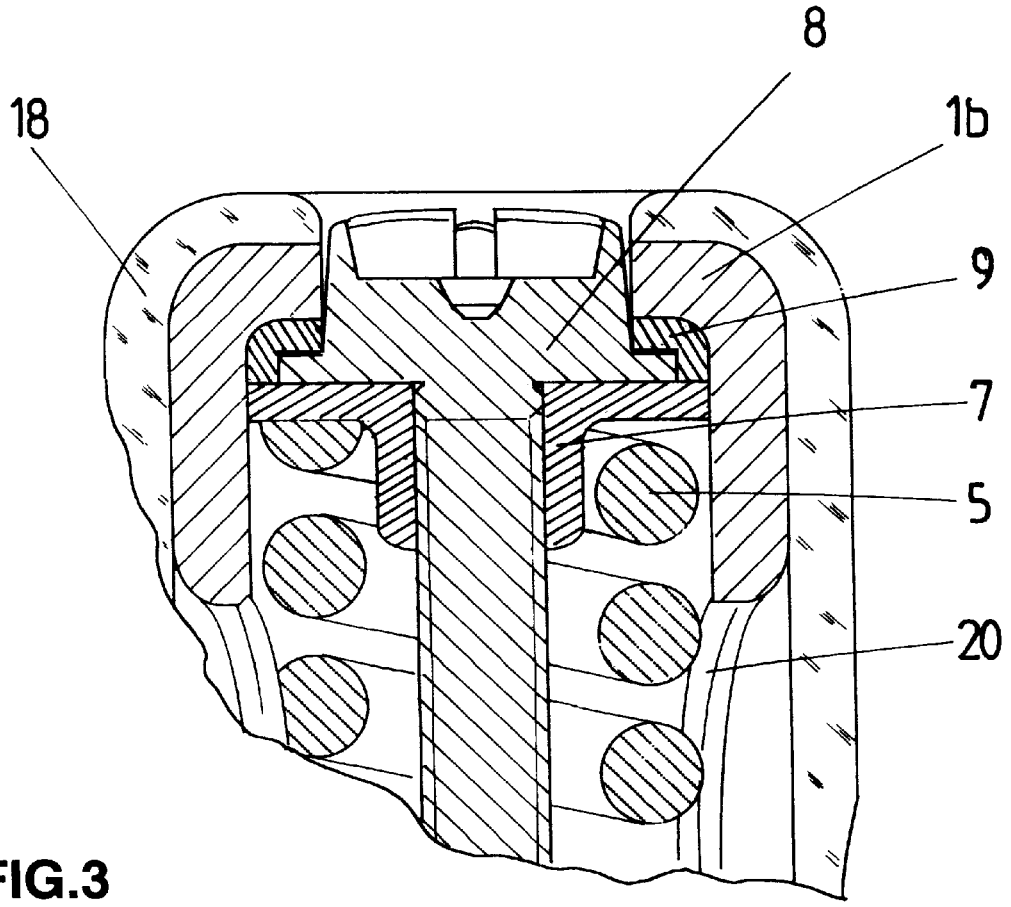
FIG. 3 is an enlargement of the upper part of the axial section, represented in FIG. 2, of the binding body.
Figure 4:
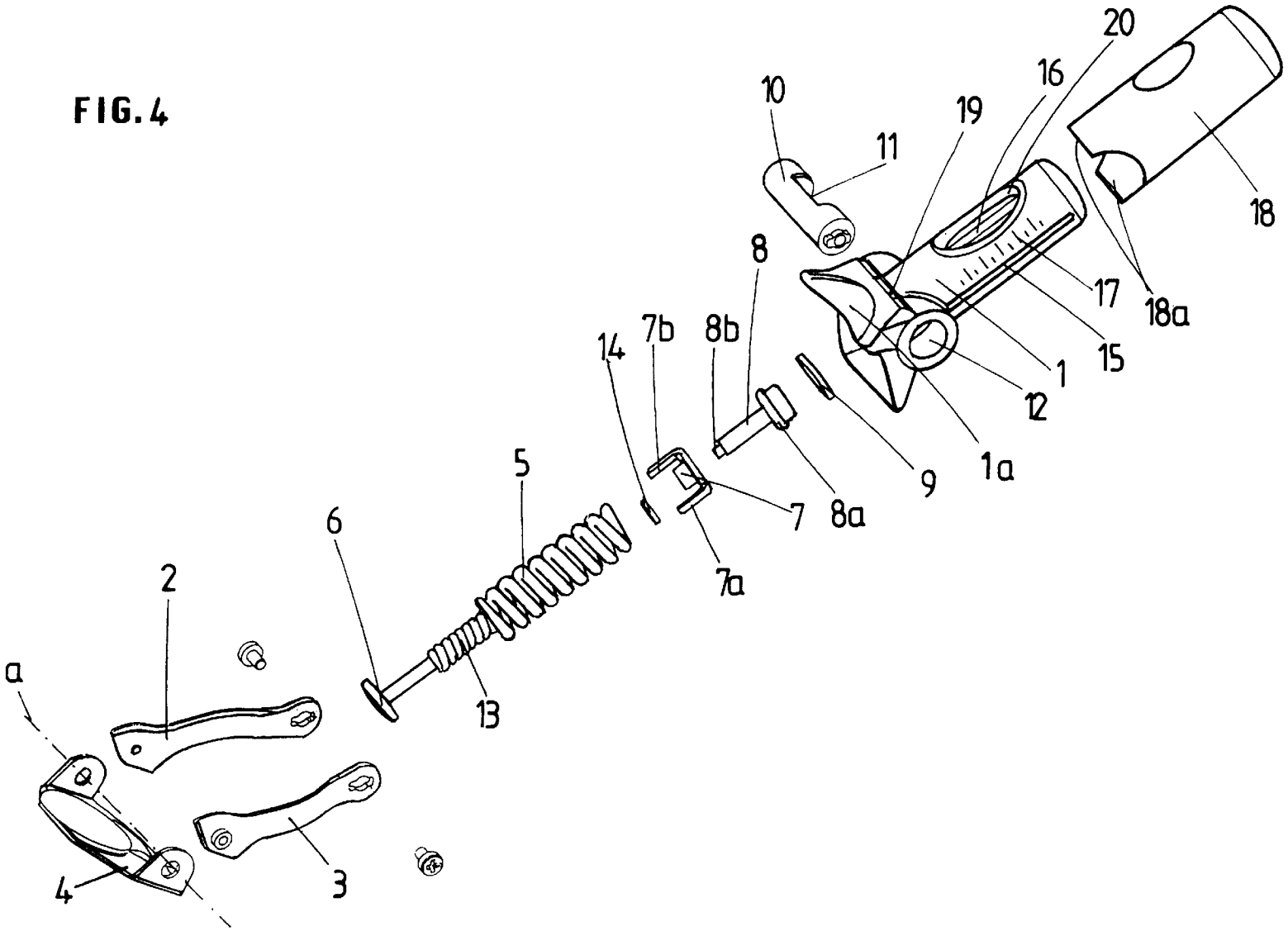
FIG. 4 is an exploded view of the binding.

Like the binding described in patent CH 397 500, the binding which is represented is characterized by a tubular cylindrical body 1 formed integrally with a heel grip 1*a*. This body 1 is articulated about a cam 10 which forms part of a U-shaped stirrup piece whose arms 2 and 3 are articulated onto a base plate 4 about a horizontal axis a. The base plate 4 is mounted so as to pivot on the ski in known fashion. The body 1 is open at its two ends, that is to say it is also open on the side where the sole grip 1*a* is located. It contains a main coil spring 5, working in compression between a piston 6 and a stop 7 in the form of a nut mounted on a screw 8. The screw 8 is provided with a collar 8*a* by which the screw bears on a shoulder 1*b* of the body 1, this shoulder 1*b* surrounding the upper opening of the body 1 and forming a bearing zone for the collar 8*a* of the screw. A sliding washer 9 is interposed between the collar 8*a* and the bearing zone 1*b*. The piston 6 bears on the cam 10 which is in the general form of a cylindrical pin, passes diametrically through the body 1 and has a central part, constituting the cam proper, on which there is a flat 11. The arms 2 and 3 are fixed to the ends of this cam 10 by parts which are profiled so as to prevent the cam 10 from rotating. The body 1 has a bore 12 in order for it to rotate about the cam 10. An auxiliary spring 13 is also mounted inside the spring 5, and works in compression between the piston 6 and a washer 14 held on a bearing zone 8*b* of the end of the screw 8.

The body 1 also has two longitudinal slots 15 and 16 which are parallel to the axis of the screws and of the screw and are arranged on each side of the body 1. The stop 7 is provided with two arms 7*a* and 7*b* which are engaged in the slot 15 or 16 respectively, and can slide freely in these slots. Graduations 17 are engraved at the edges of the slots and make it possible to read the position of the cursor which the nut 7 constitutes.

The cylindrical body 1 is surrounded by a cover 18 made of a synthetic material which is transparent at least in the zone for reading the display of the setting.

The elements contained in the body 1 are fitted through the opening in the body located on the side where the sole grip 1*a* is situated. The screw 8 provided with the sliding washer 9 and the nut 7, is introduced first, followed by the springs and the piston. After the piston has been compressed, the cam 10 is next put in place then the arms 2 and 3 are fixed at the ends of the cam. The main spring 5 can be compressed by rotating the screw 8, the effect of which is to move the stop 7.

As is known from the prior art, the heel piece is opened by tilting the body 1 about the cam 10, the effect of which is to push back the piston 6 and compress the springs.

The invention is not of course limited to the example which has been represented. In particular, the screw 8 could bear axially by the front face of its head.

What is claimed is:

1. A heel piece of a safety binding for holding a boot on a ski, comprising a tubular binding body (1) having an upper opening adjacent an upper end, the upper opening having an inner bearing zone (1*b*) and a lower, unobstructed opening adjacent a lower end having an integral sole grip (1*a*), and which is articulated about a transverse cam (10) forming part of a stirrup piece (2, 3, 10) articulated about a horizontal axis onto a plate (4) mounted so as to pivot on the ski about a substantially vertical axis, this body containing at least one spring (5) which works in compression between a piston (6) bearing on the cam, and a stop secured to a setting screw (8) having a head, wherein the setting screw (8) bears axially, by its head, against the bearing zone **(1*b*) of the binding body, and wherein the stop consists of a nut (7) mounted on the setting screw (8), the nut having a visual indicator member associated therewith extending through an opening in the tubular binding body, wherein the screw, with its stop, the spring and the piston being mounted in the body (1)** through the lower end corresponding to the sole grip.

2. The heel piece as claimed in claim 1, which comprises a washer (9) with low coefficient of friction between the setting screw (8) and the bearing zone which forms part of the body and on which the screw bears.

3. The heel piece as claimed in claim 1, wherein the head of the setting screw (8) is provided with a collar **(8*a*)** by which the setting screw bears on the bearing zone of the body.

* * * * *